US008382239B2

(12) United States Patent
Leighton et al.

(10) Patent No.: US 8,382,239 B2
(45) Date of Patent: Feb. 26, 2013

(54) APPARATUS FOR REMOVING INK FROM SURFACES OF COMPONENTS IN A PRINTER

(75) Inventors: Roger G. Leighton, Rochester, NY (US); Michael Quoc Lu, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 185 days.

(21) Appl. No.: 13/017,705

(22) Filed: Jan. 31, 2011

(65) Prior Publication Data

US 2012/0194609 A1 Aug. 2, 2012

(51) Int. Cl.
*B41J 2/165* (2006.01)

(52) U.S. Cl. ..... 347/33; 347/35

(58) Field of Classification Search ..... 347/22, 347/32, 33, 35, 3, 93, 996
See application file for complete search history.

(56) References Cited

U.S. PATENT DOCUMENTS

| | | | | |
|---|---|---|---|---|
| 5,184,147 | A | 2/1993 | MacLane et al. | |
| 5,557,306 | A | 9/1996 | Fukushima et al. | |
| 5,914,735 | A | 6/1999 | Yamamoto et al. | |
| 5,949,448 | A | 9/1999 | Man et al. | |
| 6,145,958 | A | 11/2000 | Medin et al. | |
| 6,244,683 | B1 | 6/2001 | Alvarez et al. | |
| 7,455,387 | B2 | 11/2008 | Cunnington et al. | |
| 7,506,958 | B2 * | 3/2009 | Morgan et al. | 347/29 |
| 7,901,035 | B2 * | 3/2011 | Koehler et al. | 347/36 |
| 2001/0012027 | A1 | 8/2001 | Murcia et al. | |
| 2007/0076048 | A1 | 4/2007 | Cunnington et al. | |
| 2009/0102906 | A1 | 4/2009 | Phillips et al. | |
| 2010/0220145 | A1 | 9/2010 | Koehler et al. | |
| 2010/0238227 | A1 | 9/2010 | Nystrom et al. | |

* cited by examiner

*Primary Examiner* — Lamson Nyguyen
(74) *Attorney, Agent, or Firm* — Maginot, Moore & Beck, LLP

(57) ABSTRACT

A printhead cleaning device includes a housing having an opening and an ink receptacle positioned within the opening. A member has a first end positioned in the ink receptacle and a second end that extends out of the opening in the housing. The member is configured to contact a drip bib and provide a path for liquid ink to move from the drip bib to the ink receptacle.

20 Claims, 5 Drawing Sheets

APPARATUS FOR REMOVING INK FROM SURFACES OF COMPONENTS IN A PRINTER

TECHNICAL FIELD

This disclosure relates generally to imaging devices that eject ink to form images on print media, and, more particularly, to devices that clean ink from printheads in such printers.

BACKGROUND

In general, inkjet printing machines or printers include at least one printhead unit that ejects drops or jets of liquid ink onto recording media or an image forming member. A phase change inkjet printer employs phase change inks that are in the solid phase at ambient temperature, but transition to a liquid phase at an elevated temperature. A mounted printhead ejects drops of the molten ink to form an ink image. The ink can be ejected directly onto print media or onto an image receiving member before the image is transferred to print media. Once the ejected ink is onto the media or image receiving member, the ink droplets quickly solidify to form an image.

The media used in both direct and offset printers may be in sheet or web form. A media sheet printer typically includes a supply drawer that houses a stack of media sheets. A feeder removes a sheet of media from the supply and directs the sheet along a feed path past a printhead so the printhead ejects ink directly onto the sheet. In offset sheet printers, a media sheet travels along the feed path to a nip formed between the rotating imaging member and a transfix roller. The pressure and heat in the nip transfer the ink image from the imaging member to the media. In a web printer, a continuous supply of media, typically provided in a media roll, is entrained onto rollers that are driven by motors. The motors and rollers pull the web from the supply roll through the printer to a take-up roll. As the media web passes through a print zone opposite the printhead or heads of the printer, the printheads eject ink onto the web. Along the feed path, tension bars or other rollers remove slack from the web so the web remains taut without breaking.

Printers may conduct various maintenance operations to ensure that the ink ejectors in each printhead operate efficiently. A cleaning operation is one such maintenance operation. The cleaning process removes particles or other contaminants that may interfere with printing operations from the printhead and may unclog solidified ink or contaminants from inkjet ejectors. During a cleaning operation, the printheads purge ink through some or all of the ink ejectors in the printhead. The purged ink flows through the ejectors and down the front face of the printheads, where the ink drips into an ink receptacle. To control the flow of ink down the face of each printhead, some printhead assemblies include a drip bib positioned below each printhead. The drip bib has a shape that directs liquid ink toward the ink receptacle. The lower edge of the drip bib tapers to one or more channels or points where ink collects prior to dripping into the receptacle. In some printers, a wiper engages the front face of the printhead and wipes excess purged ink in a downward direction toward the drip bib to remove excess purged ink.

While existing cleaning processes are useful to maintain printheads, removing residual purged ink from the drip bib presents a challenge. Due to surface tension, a small portion of the purged ink that flows down the drip bib remains in contact with the drip bib after the cleaning process. The residual ink collects near the outlets or tips where the ink drips from the bib into the ink receptacle. In inkjet printers using a phase change ink, this residual ink may cool and solidify while on the drip bib. The solidified ink may interfere with imaging operations if the ink breaks from the drip bib. When the solidified ink separates from the drip bib, the ink may contact the web as the web moves past printheads in the print zone. The solidified ink may negatively affect image quality on the web, and the web may carry the solidified ink past one or more printheads in the print zone. Since printheads are often positioned a short distance from the web, the carried ink may contact the face of one or more printheads with adverse consequences. Thus, improved printhead cleaning is desirable.

SUMMARY

In one embodiment, a device for cleaning a printhead has been developed. The device includes a housing having an opening, an ink receptacle within the housing that is configured to hold a volume of ink and is in fluid communication with the opening in the housing, and a member having a first end and a second end. The first end of the member is positioned within the ink receptacle and the second end of the member extends out of the opening in the housing to a position that enables the second end of the member to contact a drip bib and provide a path for liquid ink to move from the drip bib to the ink receptacle.

In another embodiment, a system for collecting ink into an ink receptacle has been developed. The system includes a housing having an opening, an ink receptacle within the housing that is configured to hold a volume of ink and is in fluid communication with the opening in the housing, a printhead array having a plurality of printheads, a plurality of drip bibs, a member having a first end and a second end, and a drive mechanism configured to move the printhead array between a first position and a second position. Each printhead has a plurality of ink ejectors arranged in a face of the printhead. Each drip bib is positioned below the face of one printhead in the printhead array and configured to direct ink flowing down the face of the one printhead toward the opening in the housing. The first end of the member is positioned within the ink receptacle and the second end of the member extends out of the opening in the housing to a position that enables the second end of the member to contact at least one of the plurality of drip bibs and provide a path for liquid ink to move from the at least one drip bib to the ink receptacle. The first position places the plurality of drip bibs on a first side of the member and the second position places the plurality of drip bibs on a second side of the member that is different than the first side. The second position enables ink to flow from the plurality of drip bibs through the opening in the housing. The member is configured to contact the at least one drib bib in the plurality of drip bibs at an intermediate position that is between the first position and the second position.

DETAILED DESCRIPTION

Figure 1:
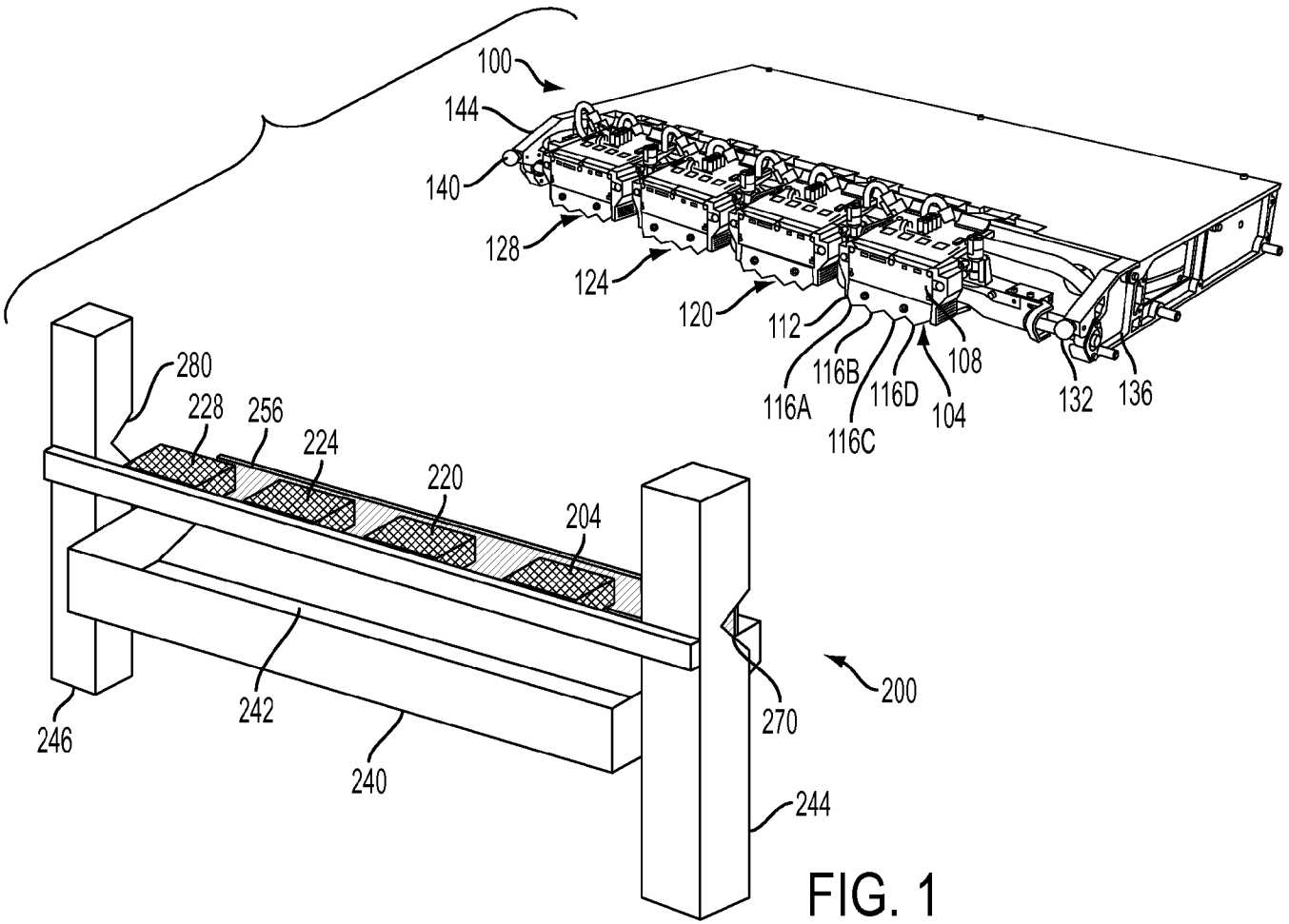
FIG. 1 is a partially exploded view of a printhead array and a cleaning unit.

For a general understanding of the environment for the system and method disclosed herein as well as the details for the system and method, reference is made to the drawings. In the drawings, like reference numerals have been used throughout to designate like elements. As used herein the term "printer" refers to any device that is configured to eject a marking agent upon an image receiving surface and include photocopiers, facsimile machines, multifunction devices, as well as direct and indirect inkjet printers. An image receiving surface refers to any surface that receives ink drops, such as an imaging drum, imaging belt, or various print media including paper.

FIG. 1 depicts a printhead array 100 and a cleaning unit 200. Printhead array 100 includes printhead units 104, 120, 124, and 128, docking balls 132 and 140, and printhead array carriage members 136 and 144. Each printhead unit includes a printhead face and a drip bib, with printhead unit 104 shown depicting a front face 108 and drip bib 112. The printhead face 108 includes an array of ink ejectors that are configured to eject ink drops onto an image receiving surface. A printer may include one or more printhead arrays, such as printhead array 100, that are configured to eject ink having one or more colors onto the image receiving surface. Cleaning unit 200 includes a housing, seen here as support rails 244 and 246 and ink receptacle 240, a mesh screen 256, and printhead wiper units 204, 220, 224, and 228. Support rails 244 and 246 hold ink receptacle 240 in place and support the wiper units 204, 220, 224, and 228. Ink receptacle 240 is a container that forms a volume with a sufficient size to hold ink purged from each of the printheads in printhead array 104 during cleaning operations. The top 242 of ink receptacle 240 is open to enable ink purged from printheads in the printhead array 100 to flow into the ink receptacle 240. While cleaning unit 200 includes a single ink receptacle 240, alternative cleaning unit embodiments may employ two or more receptacles. Rails 244 and 246 include docking members 270 and 280, respectively. The docking members 270 and 280 are configured to engage docking balls 132 and 140, respectively, on the printhead array 100 to secure the printhead array 100 to the cleaning unit 200 during purge and cleaning operations.

During purge operations, ink flows through some or all of the ink ejectors and flows down printhead face 108 instead of being ejected toward an image receiving surface in the form of ink drops. In some printhead embodiments, the printhead generates a positive pressure in an internal ink reservoir to enable ink to flow through the aperture nozzles comprising the printhead array of each printhead unit. With reference to printhead unit 104, drip bib 112, which is positioned below the printhead face 108, collects and guides ink that flows down the printhead face 108. In the embodiment of FIG. 1, drip bib 112 has a lower edge that is shaped with four points 116A-116D. The drip bib 112 guides ink toward the four points 116A-116D where the ink may drip from the drip bib 112 into the ink receptacle 240. Alternative drip bib configurations may have different shapes, and may additionally include channels formed in the drip bib to control the ink flow. One alternative drip bib configuration directs ink to a single outlet channel where the ink may drip into the receptacle. While most of the purged ink drips from the drip bib into the ink receptacle, surface tension between the ink and the drip bib 112 enables some residual ink to remain on the surface of the drip bib 112. The residual ink accumulates near the points 116A-116D along the lower edge of drip bib 112. In phase change ink printers, the temperature on the surface of drip bib 112 is often below the solidification point for the ink, enabling the residual ink to cool and solidify on the surface of drip bib 112.

In the embodiment of FIG. 1, the printhead array 100 is configured to engage with cleaning unit 200 for cleaning operations. Carriage members 136 and 144 guide the printhead array 100 and docking balls 132 and 140 engage docking members 270 and 280, respectively Each docking ball is configured to slide into a fully engaged position with the corresponding docking member in the cleaning unit. Wiper units 204, 220, 224, and 228 are secured to the support rails 244 and 246 and are positioned to wipe the faces of printheads 104, 120, 124, and 128, respectively, when printhead array 100 is engaged to the docking members 270 and 280. Typical docking members include triangular or conically shaped indentations formed in support members that are arranged along either side of an ink receptacle or an image receiving surface. While support rails 244 and 246 and ink receptacle 240 form the housing for the cleaning unit 200, the housing may be any suitable structure that secures the cleaning unit components and enables the cleaning unit to engage with a printhead array for cleaning operations.

The ink receptacle 240 is configured to receive ink from the printhead array 100 through the open top 242, and heated mesh screen 256 extends through the housing opening 242 to enable the mesh screen 256 to contact drip bibs in the printhead array 100. Mesh screen 256 has a width that is sufficient to enable the drip bib of each of the printhead units 108, 120, 124, and 128 to contact the heated mesh screen 256 as the printhead array 100 engages and disengages with the cleaning unit 200. An alternative cleaning unit configuration may include a plurality of heated mesh screens positioned within ink receptacle 240 that each engage one or some of the drip bibs in the printhead array 100.

Figure 2:
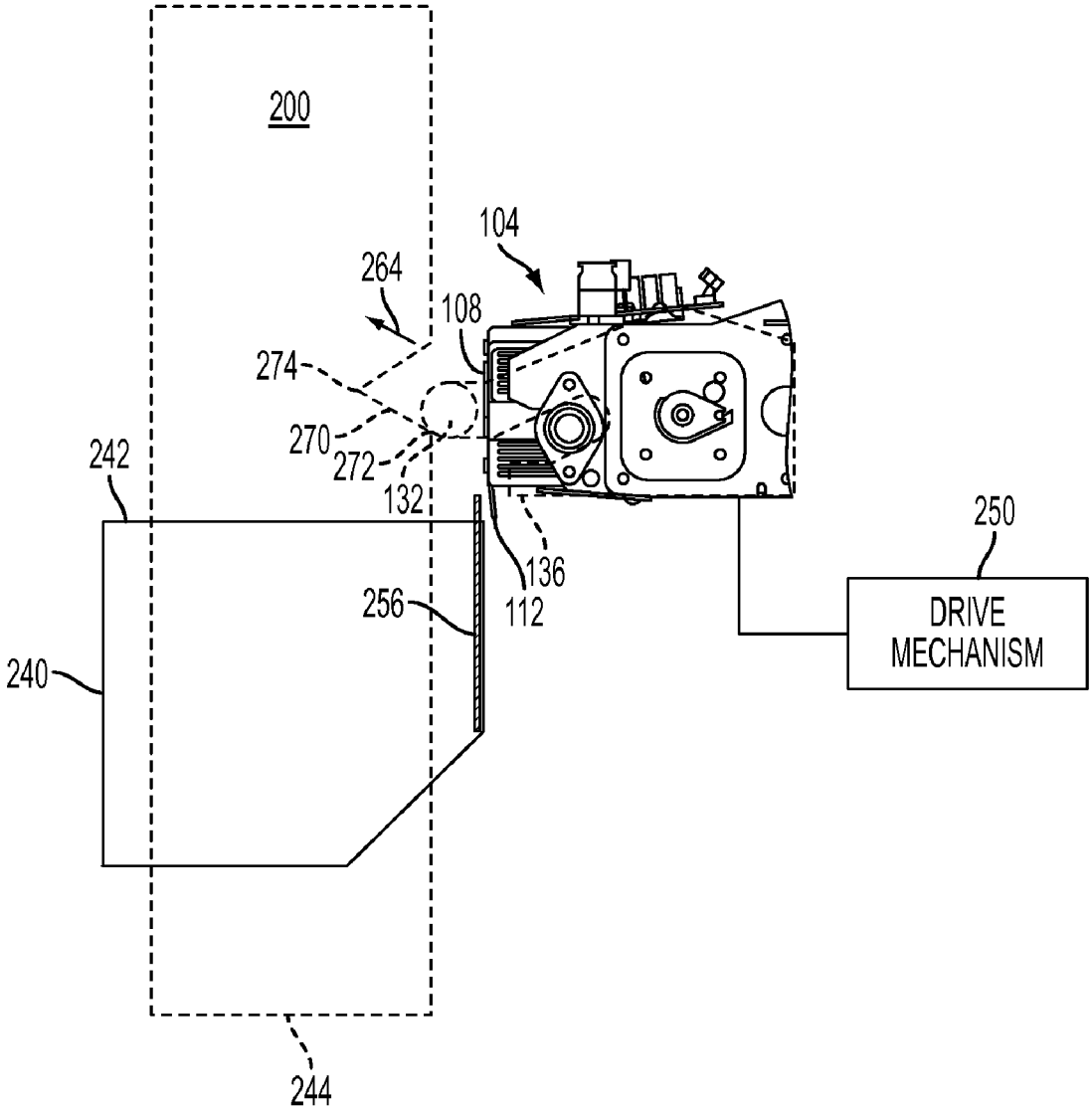
FIG. 2 is a side view of a printhead prior to engaging with a cleaning unit during a cleaning process.

FIG. 2 depicts a side view of a printhead unit 104 in a position prior to engaging the printhead unit 104 with the cleaning unit 200 and ink receptacle 240 for printhead cleaning. Ink receptacle 240 includes heated mesh screen 256. Cleaning unit 200 includes a docking member 270 in the housing guide rail 244 positioned on one side of ink receptacle 240. Docking member 270 includes lower end 272 at the opening of the docking member 270 and an upper end 274. Printhead unit 104 includes a printhead face 108 and drip bib 112 and is shown held in position by a carriage member 136. Printhead unit 104 may be one printhead in an array of printheads as depicted in FIG. 1. Carriage member 136 and docking ball 132 are configured to guide printhead unit 104 to engage with docking member 270.

In the configuration of FIG. 2, docking ball 132 engages a lower end 272 of docking member 270. A driving mechanism 250 is operatively connected to the carriage 136, docking ball 132, and printhead unit 104. Typical embodiments for drive mechanism 250 include electric motors coupled to the printhead array using gears or pulleys, hydraulic and pneumatic actuators, or any other mechanism configured to reposition printheads in the printer. The drive mechanism 250 moves the docking ball 132, carriage 136, and printhead unit 104 towards the ink receptacle. As the docking ball slides along docking member 270, printhead unit 104 begins to move in direction 264. In the position of FIG. 2, printhead face 108 and drip bib 112 are positioned outside of the ink receptacle 240 and mesh screen 256.

Figure 3:
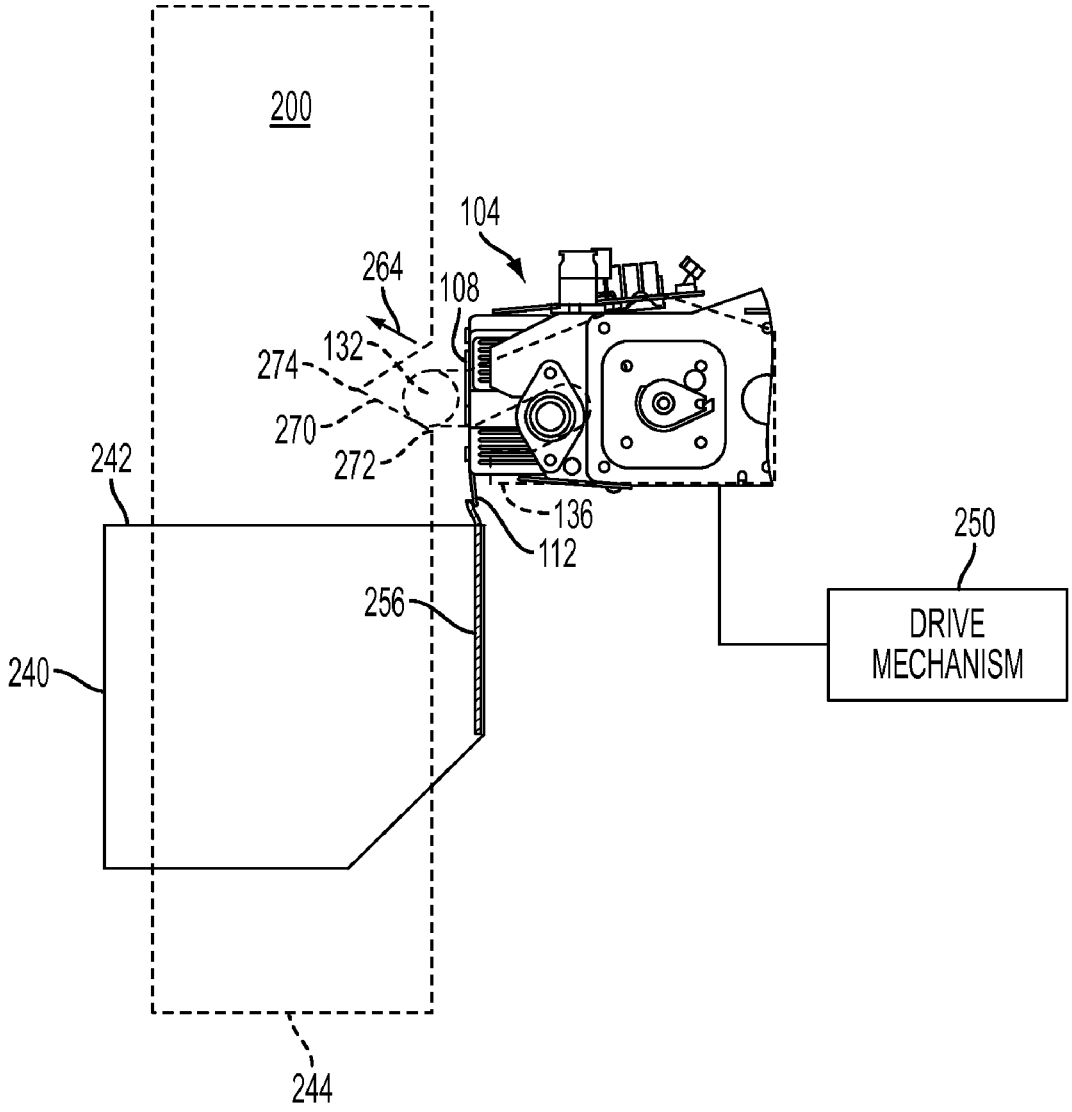
FIG. 3 is a side view of the printhead with the drip bib contacting a heated mesh while engaging a cleaning unit.

FIG. 3 depicts printhead unit 104 in an intermediate position as the printhead engages with the docking member 270.

In the configuration of FIG. 3, docking ball 132 is partially engaged with docking member 270 at a position between lower end 272 and upper end 274. Drive mechanism 250 continues to move the docking ball 132 and printhead face 108 in direction 264. The heated mesh screen 256 extends through the top opening 242 of the receptacle 240 a sufficient distance to enable the front side of drip bib 112 to contact the heated mesh screen 256. In this configuration, the heated mesh screen 256 acts as a liquid conveying member that draws liquid ink present on the drip bib into the ink receptacle 240 via capillary action while maintaining the ink in a molten state that enables gravity to move the ink through the mesh screen 256 into the ink receptacle 240. In the embodiment of FIG. 3, a power output of approximately 20 watts is required to maintain the mesh screen 256 above the heat of fusion temperature. The mesh screen may be formed from various materials including multiple metallic wires that are woven together into a mesh that is suitable for use with various inks purged from the printhead. One embodiment uses an aluminum mesh due to the high thermal conductivity of aluminum and since aluminum is not chemically reactive to the molten ink. Mesh screen 256 also extends through the opening 242 in the ink receptacle 240 to enable ink collected from the drip bib to flow into the ink receptacle 240 via capillary action. The mesh screen 256 may deform when in contact with the drip bib 112 to enable the drip bib 112 to move in direction 264 without damaging the drip bib 112.

In printers employing phase change inks, the drip bib 112 may hold solidified ink instead of liquid ink. To liquefy solidified ink, mesh screen 256 may be configured to generate heat prior to contacting the bib 112. Specifically, an electrical current source may be connected to the mesh screen 256 to apply an electrical current to a kapton heater attached to the mesh and generate heat to liquefy ink on the drip bib 112. The kapton heater may be positioned proximate to the mesh screen 256 in the ink receptacle 240, or may be interwoven with the mesh screen 256. In embodiments that employ multiple mesh screens, the electrical current source may supply electrical current to each mesh screen through a common electrical conductor in a series circuit, or each mesh screen may be connected to the electrical current source in parallel. To reduce energy consumption, the electric current may be applied to heat the mesh screen 256 only during printhead maintenance operations when the mesh screen 256 may contact the drip bib 112. In an alternative embodiment, one or more heaters positioned within the ink receptacle 240 may generate heat that brings mesh screen 256 to a temperature that is sufficient to melt solidified ink.

Figure 4:
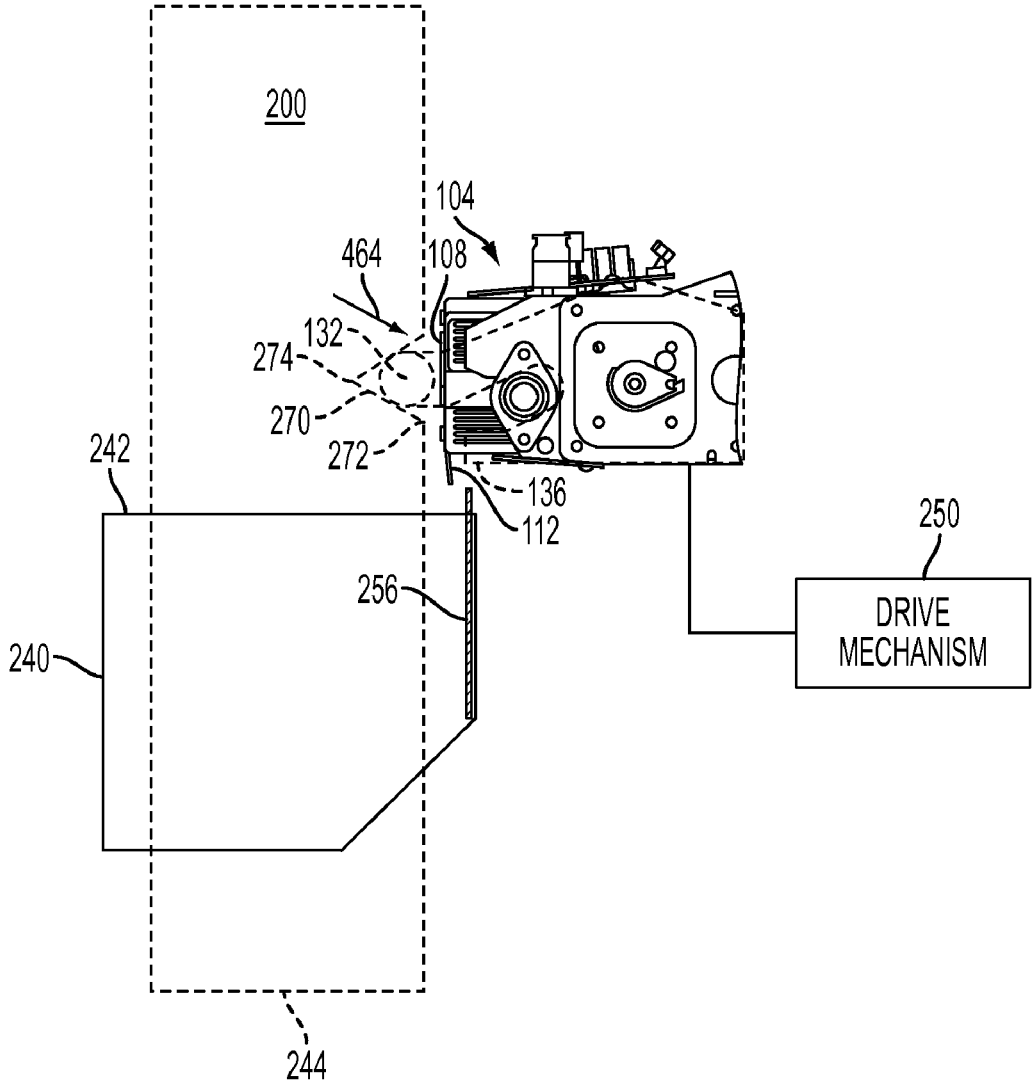
FIG. 4 is a side view of the printhead engaged with the cleaning unit.

FIG. 4 depicts printhead unit 104, carriage 136, and docking ball 132 engaged with docking member 270. Docking ball 132 is shown engaged with docking member 270, although the docking ball 132 does not establish direct contact with the upper end 274 in the embodiment of FIG. 4. In the position of FIG. 4, printhead face 108 and drip bib 112 are both positioned over the opening 242 of ink receptacle 240 inside of the mesh screen 256. Printhead unit 104 may undergo a cleaning operation that includes purging ink through ink ejectors in printhead face 108. The purged ink may flow down printhead face 108 and drip bib 112 directs the ink into ink receptacle 240 through opening 242. In some printers, the cleaning process also includes a wiper assembly (not shown) that wipes the printhead face 108 to clean contaminants and ink from the printhead unit 104. In the configuration of FIG. 4, drip bib 112 is separated from the mesh screen 256. This separation enables purged ink to drip from the drip bib 112 through opening 242 into the ink receptacle 240 under the force of gravity. Once the cleaning process is complete, the printhead unit 104 moves in direction 464 to disengage from the docking member 270.

Figure 5:
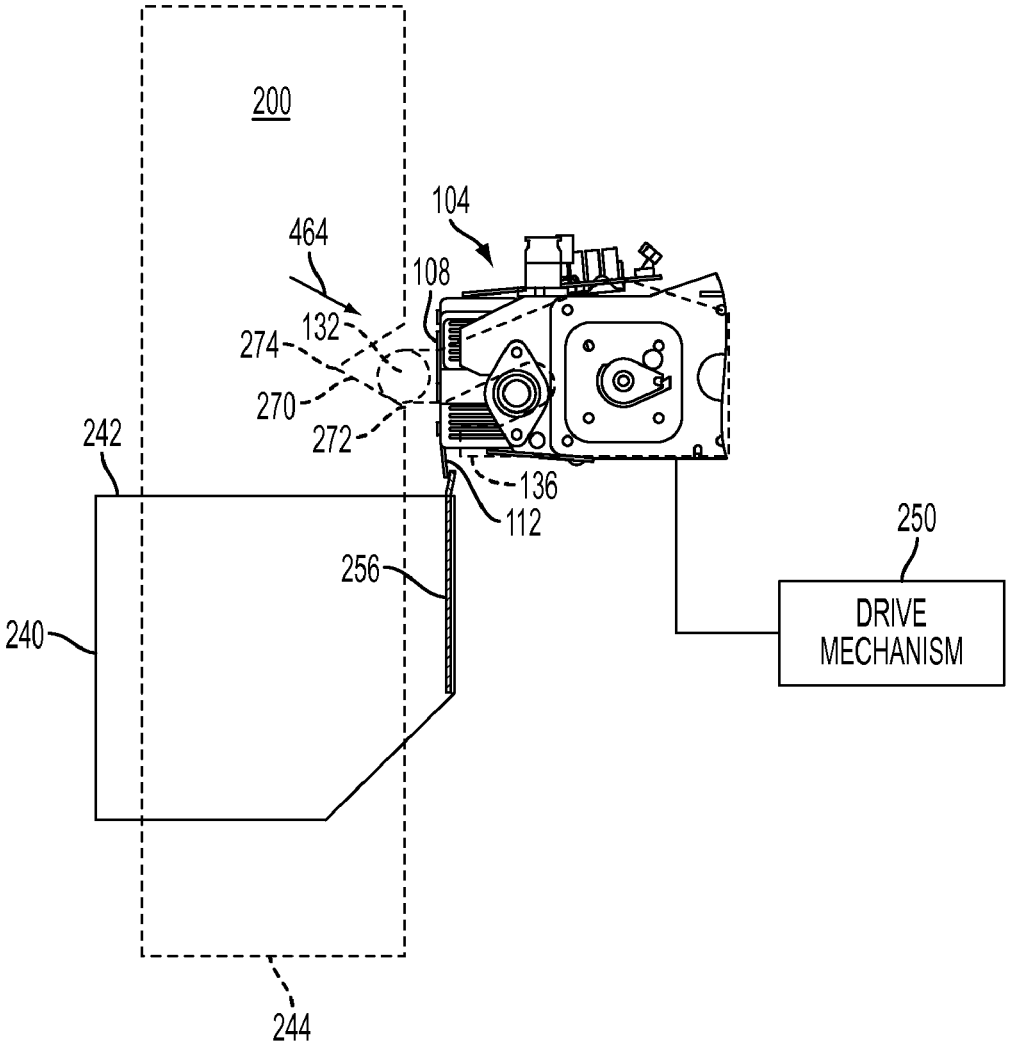
FIG. 5 is a side view of the printhead with the drip bib contacting the heated mesh while disengaging from the cleaning unit.

FIG. 5 depicts printhead unit 104 in an intermediate position as the printhead disengages from the docking member 270. In FIG. 5, the back surface of drip bib 112 contacts mesh screen 256. The mesh screen 256 may contact ink on the drip bib and draw the ink into the ink receptacle 240 using capillary action as described above with reference to FIG. 3. Additionally, the mesh screen 256 may generate heat to liquefy solidified ink on the drip bib 112. The contact between the drip bib 112 and mesh screen 256 shown in FIG. 5 occurs soon after the printhead unit 104 purges ink. Thus, the heated mesh 256 screen draws some or all of the residual ink from the purge operation adhering to the lower edge of the drip bib into the receptacle 240. The ink receptacle 240 holds molten ink from the purge operation that also provides heat to melt solidified ink that may be present on the mesh screen 256. To provide additional time for the mesh screen 256 to draw ink from the drip bib 112, the drive mechanism 250 may hold printhead unit 104 in the intermediate position of FIG. 5 with the drib bib 112 in contact with the mesh screen 256 for a predetermined time period. The drive mechanism 250 then moves printhead unit 104 in direction 464 to disengage from the ink receptacle 240.

The foregoing embodiments are merely illustrative of a system that may remove ink from various surfaces of printer components. In addition to drip bibs, other printer components having surfaces that collect ink may have the ink removed using a liquid conveying member similar to the mesh screen 256 depicted above. Mesh screen 256 is shown in a phase change ink printing device, but the mesh screen may convey various liquids, including various forms of liquid ink, as well. A liquid conveying member, such as mesh screen 256, and an ink receptacle may be positioned in various locations in a printer to enable the liquid conveying member to draw ink from various printer components. While the foregoing embodiments move the printhead units with respect to the liquid conveying member, alternative printing mechanisms may instead move the liquid conveying member to contact printer components that bear ink.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed:

1. A printhead cleaning device for use in an inkjet printer comprising:

a housing having an opening;

an ink receptacle within the housing that is configured to hold a volume of ink, the ink receptacle being in fluid communication with the opening in the housing; and a member having a first end and a second end, the first end of the member being positioned within the ink receptacle and the second end of the member extending out of the opening in the housing to a position that enables the second end of the member to contact a drip bib and provide a path for liquid ink to move from the drip bib to the ink receptacle.

2. The printhead cleaning device of claim 1 wherein the member has a width that enables the member to contact a plurality of drip bibs extending from a printhead.

3. The printhead cleaning device of claim 1, the member further comprising:

a mesh screen configured to wick ink away from the drip bib.

4. The printhead cleaning device of claim 3, the mesh screen comprising:

a plurality of metallic wires in a woven arrangement.

5. The printhead cleaning device of claim 1 wherein the member is operatively connected to an electrical current source to enable the member to generate heat and liquefy solidified ink on the drip bib in response to electrical current flowing through the member.

6. The printhead cleaning device of claim 1 wherein the receptacle and the opening in the housing have having a width that corresponds to a plurality of printheads.

7. The printhead cleaning device of claim 1 further comprising:

a plurality of members, each member having a first end and a second end, the first end of each member being positioned within the ink receptacle and the second end of each member extending out of the opening in the housing to a position that enables the second end of each member to contact at least one drip bib in a plurality of drip bibs and provide a path for liquid ink to move from the at least one drip bib to the ink receptacle.

8. The printhead cleaning device of claim 7, each member in the plurality of members further comprising:

a mesh screen configured to wick ink away from the at least one drip bib.

9. The printhead cleaning device of claim 8, each mesh screen comprising:

a plurality of metallic wires in a woven arrangement.

10. The printhead cleaning device of claim 7 wherein each member in the plurality of members is operatively connected to an electrical current source to enable each member to generate heat and liquefy solidified ink on the at least one drip bib in response to electrical current flowing through each member.

11. A system for collecting ink into an ink receptacle, comprising:

a housing having an opening;

an ink receptacle within the housing that is configured to hold a volume of ink, the ink receptacle being in fluid communication with the opening in the housing;

a printhead array having a plurality of printheads, each printhead having a plurality of ink ejectors arranged in a face of the printhead;

a plurality of drip bibs, each drip bib positioned below the face of one printhead in the printhead array and configured to direct ink flowing down the face of the one printhead toward the opening in the housing;

a member having a first end and a second end, the first end of the member being positioned within the ink receptacle and the second end of the member extending out of the opening in the housing to a position that enables the second end of the member to contact at least one of the plurality of drip bibs and provide a path for liquid ink to move from the at least one drip bib to the ink receptacle; and a drive mechanism configured to move the printhead array between a first position and a second position, the first position placing the plurality of drip bibs on a first side of the member and the second position placing the plurality of drip bibs on a second side of the member that is different than the first side, the second position enabling ink to flow from the plurality of drip bibs through the opening in the housing, the member being configured to contact the at least one drib bib in in the plurality of drip bibs at an intermediate position that is between the first position and the second position.

12. The system of claim 11, the member further comprising:

a mesh screen configured to wick ink from the at least one drip bib.

13. The system of claim 12, the mesh screen comprising:

a plurality of metallic wires in a woven arrangement.

14. The system of claim 11 wherein the member is operatively connected to an electrical current source to enable the member to generate heat and liquefy solidified ink on the drip bib in response to electrical current flowing through the member.

15. The system of claim 11, the printhead array further comprising:

a slidable member; and the housing further comprising:

a docking member having a lower end and an upper end, the slidable member being configured to engage the lower end of the docking member when the printhead array is in the first position and to move toward the upper end of the docking member in response to the drive mechanism moving the printhead array to the second position.

16. The system of claim 11, the drive mechanism being further configured to position the printhead array at the intermediate position for a predetermined time period to enable the liquid conveying member to contact the plurality of drip bibs for the predetermined time period.

17. The system of claim 11 further comprising:

a plurality of members, each member having a first end and a second end, the first end of each member being positioned within the ink receptacle and the second end of each member extending out of the opening in the housing to a position that enables the second end of each member to contact at least one drip bib in a plurality of drip bibs and provide a path for liquid ink to move from the at least one drip bib to the ink receptacle.

18. The system of claim 17, each member in the plurality of members further comprising:

a mesh screen configured to wick ink from the at least one drip bib.

19. The system of claim 18, each mesh screen comprising:

a plurality of metallic wires in a woven arrangement.

20. The system of claim 17 wherein each member in the plurality of members is operatively connected to an electrical current source to enable each member to generate heat and liquefy solidified ink on the at least one drip bib in response to electrical current flowing through each member.

* * * * *